United States Patent [19]

Valle et al.

[11] Patent Number: 4,651,795

[45] Date of Patent: Mar. 24, 1987

[54] PLEATED FABRIC WINDOW COVERING CORD LOCK

[75] Inventors: Louis G. Valle, Huntington Beach; Robert J. Voss, Fountain Valley, both of Calif.

[73] Assignee: Beatrice Foods, Denver, Colo.

[21] Appl. No.: 842,290

[22] Filed: Mar. 21, 1986

[51] Int. Cl.[4] ..... E06B 9/38; E06B 9/324

[52] U.S. Cl. ..... 160/178 C; 24/136 A; 160/168 R

[58] Field of Search ..... 160/178 C, 168 R, 177; 24/136 R, 115 L, 115 M; 188/65.1

[56] References Cited

U.S. PATENT DOCUMENTS

| | | | |
|---|---|---|---|
| 3,204,311 | 9/1965 | Laviano | 24/115 L |
| 3,952,789 | 4/1976 | Marotto | 160/168 R |
| 3,996,988 | 12/1976 | Wit | 160/168 R |
| 4,180,118 | 12/1979 | Vecchiarelli | 160/178 C |
| 4,250,597 | 2/1981 | Ford | 160/178 C |
| 4,352,386 | 10/1982 | Butler | 160/178 C |
| 4,425,956 | 1/1984 | Terlecke | 160/168 R |
| 4,531,563 | 7/1985 | Nilsson | 160/168 R |

*Primary Examiner*—Reinaldo P. Machado
*Attorney, Agent, or Firm*—George J. Netter

[57] ABSTRACT

A cord lock having a first movable pin at one side of the cord, the other side of the cord being supported by a fixed pin, the movable pin pinching or clamping the cord against the fixed pin. The movable pin has toothed end portions and splines in the central portion. The toothed end portions mesh with racks within a housing to maintain a constant attitude for the moving pin and the splines engage the cords. A rectangular guide slides into the open end of the headrail with a first molded plastic part fitting over the open end of the headrail and end of the guide. The cord lock housing fits onto the molded plastic part and is free to rotate within the part providing self adjustment of the cord during use.

8 Claims, 14 Drawing Figures

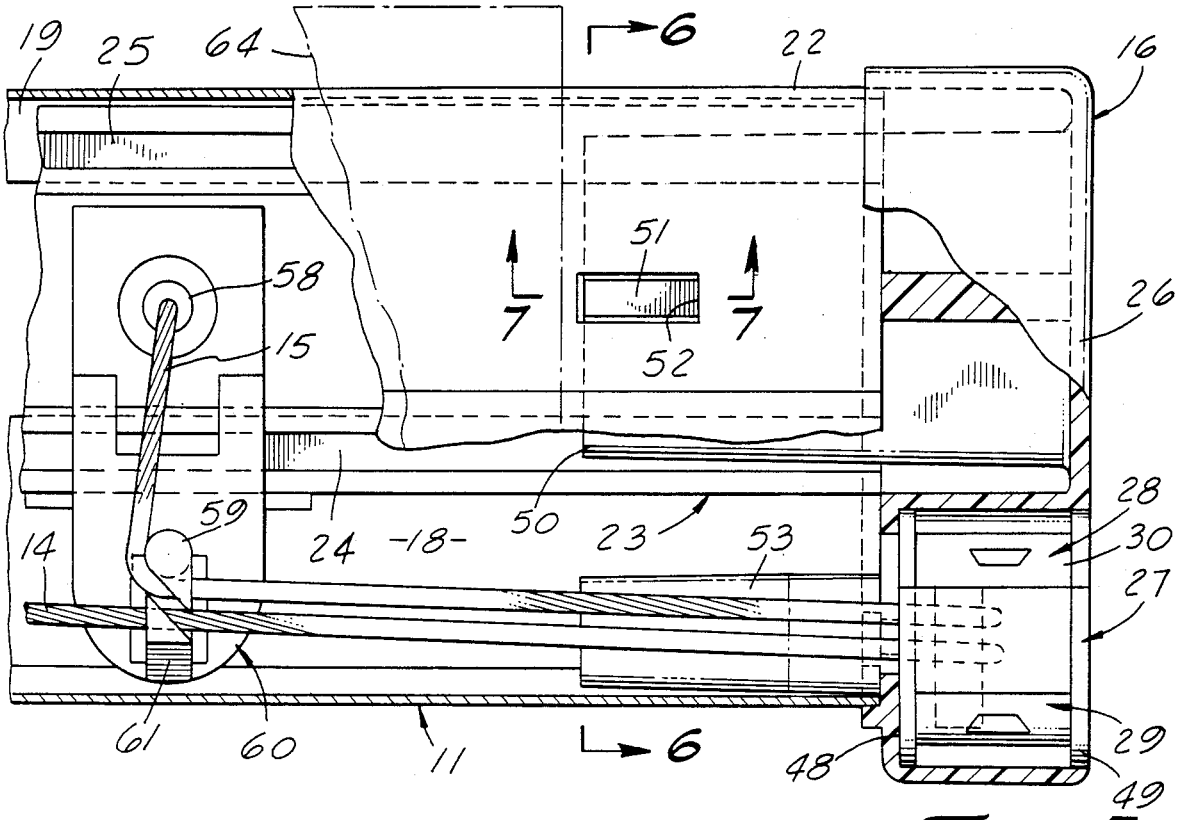
FIG. 5
FIG. 6
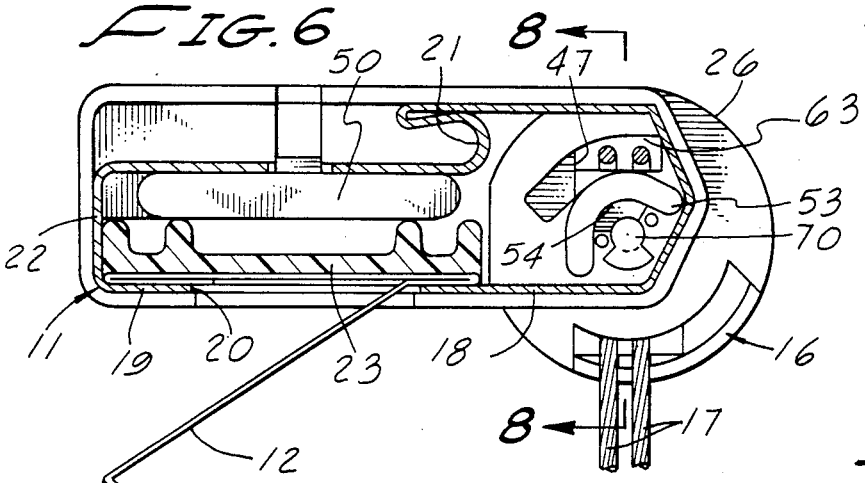
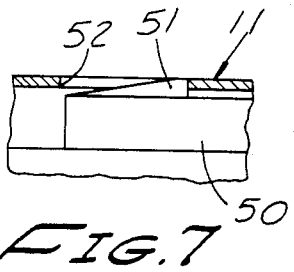
FIG. 7
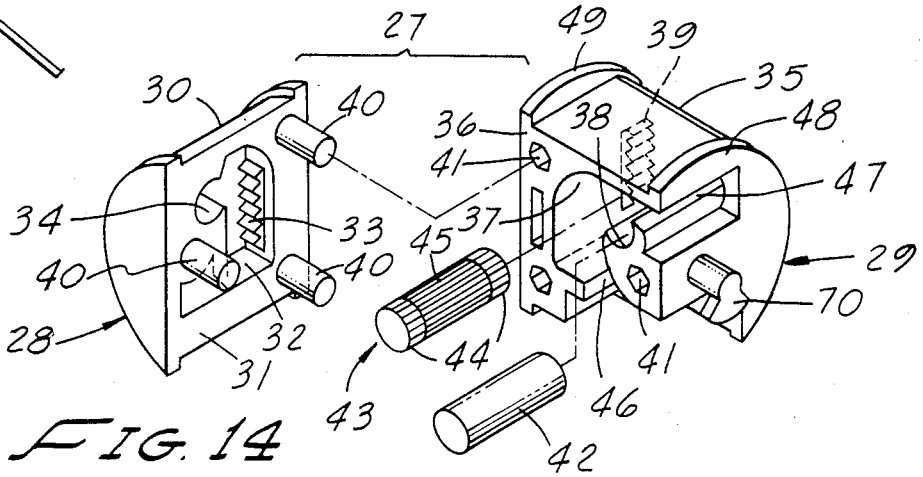
FIG. 14

9

PLEATED FABRIC WINDOW COVERING CORD LOCK

The present invention pertains generally to a window covering or window blind of the type referred to frequently as a pleated fabric blind, and more particularly, to a locking device for one or more cords which are manipulated to adjust the blind height.

BACKGROUND OF THE INVENTION

A very popular type of window covering for some time has been one referred to as a venetian blind in which a plurality of slats are adjustable to various relative angles to one another to control the amount of light passing through (and thus the degree of viewing) and which also can be raised or lowered to any desired height. A further highly successful window covering unit having some features in common with a venetian blind includes a pleated fabric which can be raised or lowered to any desired height.

Adjustment of the cords to produce a desired height of the window covering for either a conventional blind or a pleated fabric window covering is typically accomplished by manipulation of an extent of the cords hanging downwardly from a head rail via which the window covering is mounted and supported. After an adjustment of the window covering has been accomplished, it is necessary to secure the cord in order to maintain the window covering height at its new adjusted position.

A very early manner of achieving this was to provide a peg or post located immediately adjacent the blind to which the cord was tied in a suitable manner. This approach was not fully satisfactory in that frequently the cord would become loosened, allowing the blind to fall, and in many other circumstances there was simply no convenient place to which the tie post could be mounted. More recently, several different types of so-called "cord locks" have been provided incorporated into the head rail, which upon selective angular adjustment of the cord, enables vertical adjustment of the blind height, and on release of the cord at a new angle of adjustment the cord is automatically locked into the new position which, in turn, keeps the blind height constant until it is affirmatively changed.

One prior art cord lock, is that shown in U.S. Pat. No. 4,245,688 in which a fixed guide roller is mounted between front and rear plates and a lock roller is slidably related along arms of a slot within which it is received in order to releasably secure a cord between the two rollers.

A copending U.S. patent application Ser. No. 242,057, WINDOW BLIND CORD LOCK by C. M. McNeil and L. G. Valle, which application is assigned to the same assignee as the present application, discloses a venetian blind cord lock having a movable smooth surfaced roller which wedges against a fixed roller to secure the adjustment cord therebetween. Although the construction of this prior known cord lock represents a considerable step forward in regard to economy of manufacture, it still is now completely satisfactory in that on occasion, depending upon unusually large pulling forces and direction of pull applied to the cords, the moving roller becomes canted along its path of movement, resulting in slippage of the cord within the cord lock. In addition, in the event of wear of the cord to the point where substantial reduction in cord cross section is experienced, this can result in the cord lock being ineffective on that portion of the cord, such that the cord will slip and, of course, the blind will experience a corresponding amount of readjustment.

SUMMARY OF THE DISCLOSURE

The cord lock of the invention described herein is of the general kind having a first movable pin at one side of the cord, the other side of the cord being supported by a fixed pin, the movable pin pinching or clamping the cord against the fixed pin. The movable pin has each of its end portions formed into circumferentially extending teeth with the central portion being provided with a set of longitudinal splines. The teeth on the pin end portions move along racks within a housing to maintain a constant attitude for the moving pin while the central ribbed or splined portion engages the cord. At the upper end of the rack, the wall on which the rack is located curves toward the fixed pin providing a continuing reduction in spacing between the two pins until a point of zero spacing or pinch is reached.

First and second molded plastic housing parts are adapted to fit together enclosing the movable pin and the fixed pin into a unitary lock housing through which the cord passes and is acted upon. More particularly, a first housing part has a molded rack with a set of teeth for meshing with the teeth on one end of the movable pin. Also, at a proper spacing is an opening for receiving one end of the fixed roller. The second housing part includes a similar rack of teeth spaced and generally parallel to that of the first set of teeth when the housing parts are assembled, and, in addition, a curved supporting surface against which the fixed pin's other end rests. In assembly, the two housing parts fit together with the fixed pin having its ends received in the appropriate openings of the two housing parts and the movable pin is at the lowermost extent of the rack, a space exists between the two pins (at the low end of the rack) which is several times the cord width. Movement of the pin from this first extreme along the racks gradually reduces the space between the pins to a minimum which is substantially less than the cord diameter, thereby providing the cord lock with what is termed as "zero" pinch.

A typical window covering unit with pleated blinds includes a headrail which in the described embodiment is constructed of thin metal with a generally U-shaped cross-section, an open bottom and the top wall folded back on itself forming an elongated rearwardly facing recess. A pair of identical U-shaped mounting brackets have one end of each wedged into the headrail top wall recess and the cross-arms abutting against the headrail back wall. Threaded members can affix the mounting bracket to a ceiling or vertical wall surface as desired.

An elongated rectangular guide is slid into the open end of the headrail and includes a pair of parallel, upwardly facing channels along which the window covering adjustment cords extend. The guide is of such a length as to enable being substantially coterminous with the headrail ends when assembled therein.

A first molded plastic part fits over the one open end of the headrail and end of the guide. The cord lock housing fits onto the molded plastic part and is free to rotate within the part providing self adjustment of the cord during use. The cord is received within the cord lock housing, threaded between the two pins and through openings in the first part, extends along the guide channels and downwardly through the openings in the pleated window cover.

DESCRIPTION OF THE DRAWING

FIG. 5 is a top plan, sectional, partially fragmentary view taken along the line 5—5 of FIG. 2.

FIG. 6 is a side elevational, sectional view taken along the line 6—6 of FIG. 5.

FIG. 7 is a side elevational view of the molded part retention means and headrail taken along 7—7 of FIG. 5.

FIG. 14 is an exploded view of the cord lock housing.

DESCRIPTION OF A PREFERRED EMBODIMENT

Figure 1:
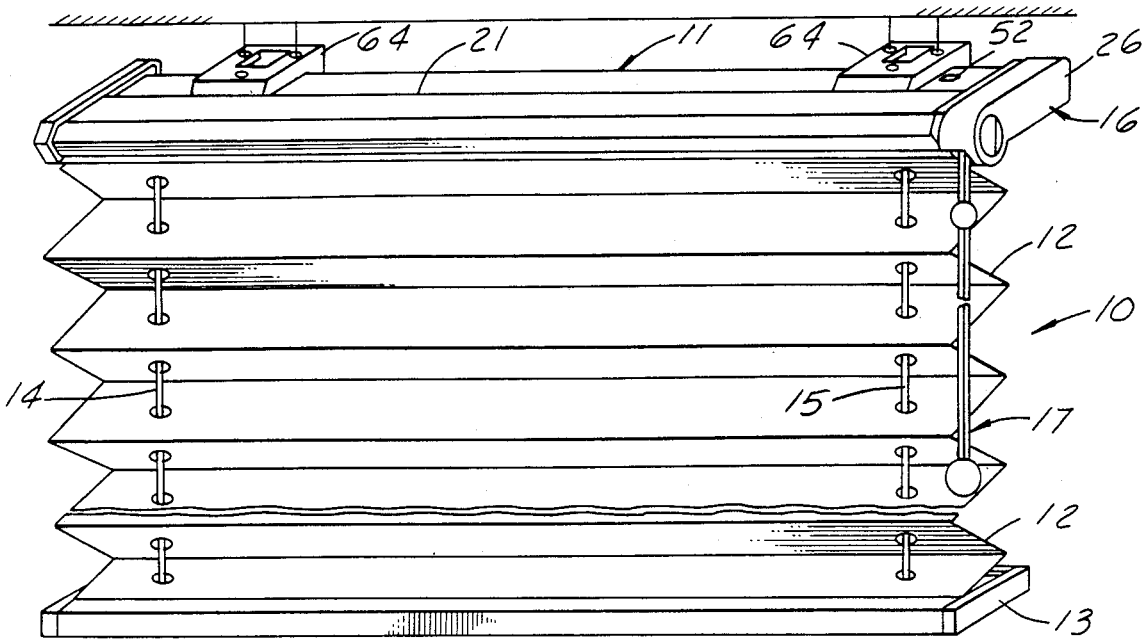
FIG. 1 is a perspective, frontal view of an extended pleated window covering showing the described cord lock assembled at one end of the headrail.
Figure 2:
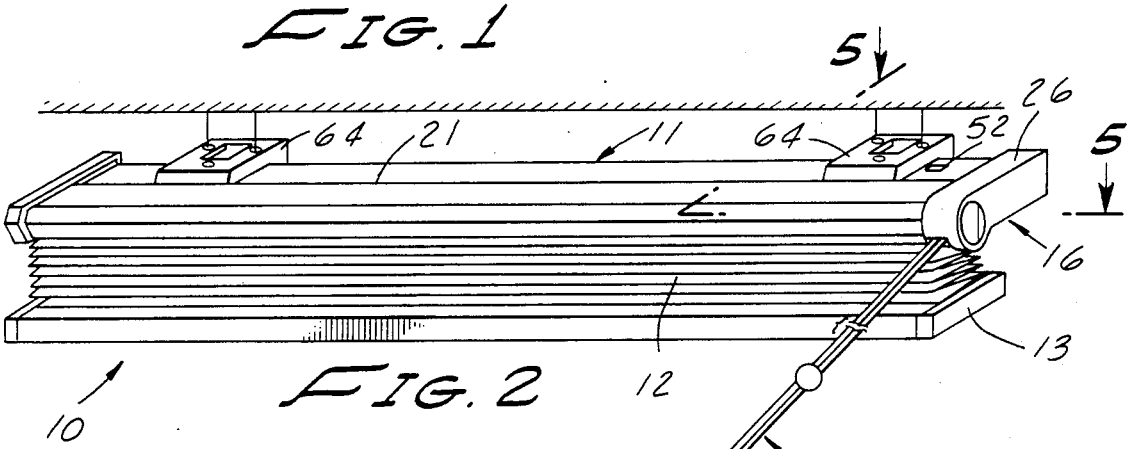
FIG. 2 is a perspective view similar to FIG. 1 showing the window covering in fully raised condition.

With reference now to the drawing and particularly FIGS. 1 and 2, there is shown a so-called pleated window covering identified generally as at 10. In its major parts, the window covering includes a headrail 11 which is mounted to a window frame, wall or ceiling and from which a length of pleated material 12 hangs. The lower end of the material is affixed to a second or lower rail 13. First and second cords 14 and 15 each have one end affixed to the lower rail 13, pass upwardly through openings in the two end portions of the covering 12, and pass through the cord control 16 to terminate in a common length 17 which hangs downwardly from the cord lock housing. These outer cord ends are manipulated in a well-known way to raise or lower the covering. More particularly, adjustment of the external hanging cord 17 can move the blind from an extended condition as in FIG. 1 to a totally open position as in FIG. 2, and, on release of the cord, the cord-lock automatically will retain any preset or preadjusted position.

Figure 13:
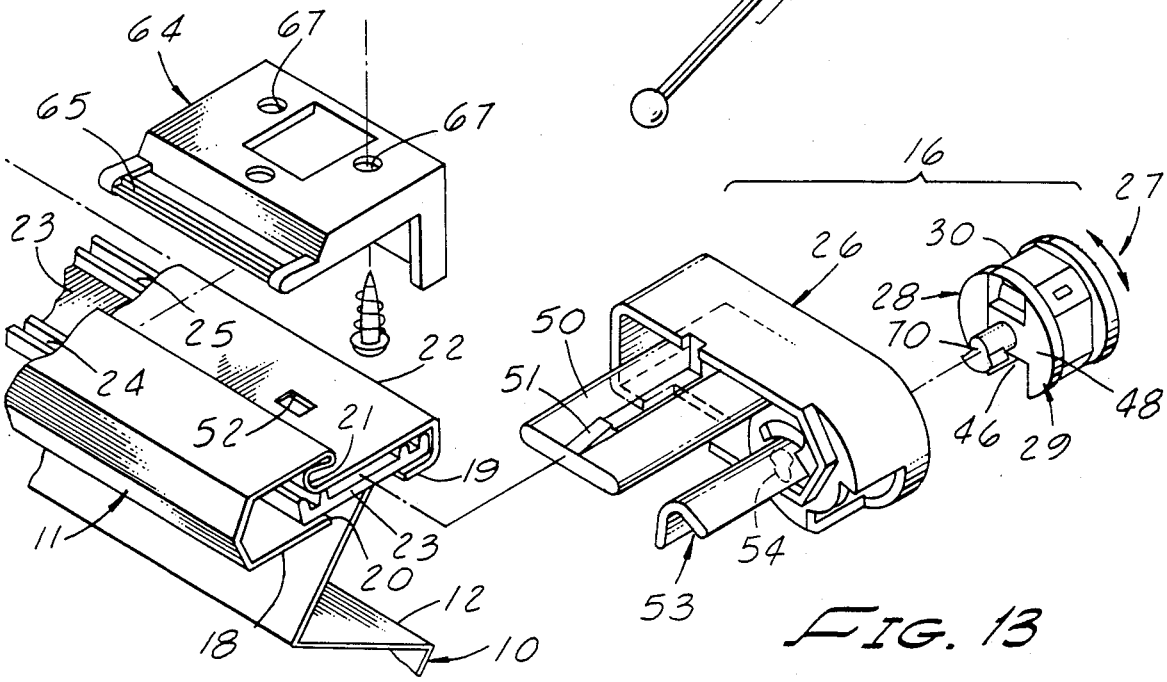
FIG. 13 is an exploded perspective view of cord lock and headrail parts.

As can be seen in FIGS. 13, for example, the headrail 11 consists of an elongated, open bottom housing constructed of either thin metal or molded plastic which is generally "U" shaped in cross-section with its side wall edge portions turned toward each other defining flanges 18 and 19 at opposite sides of the bottom opening 20. The top wall of the headrail housing has a centrally located portion which is bent back upon itself to form an elongated channel 21 generally parallel to the front and back headrail edge walls and facing the rear edge wall 22.

An elongated guide plate 23 is generally rectangular and has raised wall portions on a major surface defining first and second channels 24 and 25, one immediately adjacent each long edge. The dimensions of the guide plate are such as to enable sliding receipt within the headrail for a purpose to be more particularly described. Preferably, this guide plate is constructed of either molded or extruded synthetic plastic.

Turning now to FIG. 13, the cord control 16 is seen to include separate molded parts, preferably of a synthetic plastic, which fit together forming a unitary construction to be received within the open end of the headrail 11 closing the same and including the cord lock parts. More particularly, a molded cover 26 has parts which are received within the open end of the headrail providing a smooth exterior surface to the cord control 16 (FIG. 1). A cord lock housing 27 is located within and readily removable from an opening formed in the outer surface of the cover 26 and includes the active cord lock parts which will now be described.

With reference to FIG. 14, the cord lock housing 27 is seen to consist generally of two molded shells 28 and 29 fit together forming a cylindrical member. The shell 28 has a curved outer surface 30 with a flat face 31 on one side. The central portion of the flat face 31 has material removed to form a cavity 32 on one inner wall of which a toothed rack 33 is formed. Directly opposite one end (the upper end, in use) of the rack 33 and on the opposite wall of the cavity is a circular opening 34 having a portion of one side open. The axis of opening 34 lies in a plane parallel to the plane of the rack and substantially 90 degrees to the line of rack teeth.

The other lock housing shell 29 has an outer curved surface 35 over a substantially portion and a flat surfaced side 36 for abutting against face 31 on the first shell 28. A central cavity 37 is configured to communicate with the cavity 32 on mating of the two shells. A portion of one wall of cavity 37 is formed into a circularly curved pedestal 38, and on a wall directly opposite to the pedestal a toothed rack 39 extends.

On assembly of the shells 28 and 29 as described to this point, the flat-faced surfaces 31 and 36 abut one another with dowel-like members 40 integral with shell 28 being received within openings 41 in the flat face of shell 29. When so mated, the opening 34 is colinear with the circular axis of pedestal 38, and the two racks 33, 39 are in a common plane with their respective upper and lower ends aligned.

A smooth surface cylindrical metal pin 42 is of such dimensions that it can be received within the curved pedestal and opening 34 and firmly held therewithin an assembly of the housing shells. This pin will be referred to as the "fixed" pin in certain descriptive material to follow.

A second cylindrical pin 43 has each of its end portions formed with a set of circumferentially extending teeth 44. The teeth on the end portion of the pin are constructed to mesh with the teeth on the housing racks 33 and 39. The central portion of the pin 43 between the sets of each teeth includes a plurality of longitudinally extending splines 45 which, as will be more particularly described, serve to secure more tightly and frictionally the cords 14 and 15 during use. On initial assembly of the two housing shells the metal pin 43 has its toothed end portions 44 engaged with the teeth on the racks 33 and 39 and since the respective teeth on the two racks are colinear with each other, this insures that throughout most use the pin 43 will be confined to a continuous meshing relationship with the racked teeth. This movement of the pin along the racks maintains the pin at a constant angular attitude to the fixed pin 42 and (as will be seen) transversely to the cords 14, 15.

An elongated slot 46 in the bottom wall of the second housing shell 29 extends generally parallel to the curved pedestal 38 and lies under the pedestal between the rack and pedestal. In the end of the shell surface opposite the wall carrying the rack 39 there is a further slot 47, extending through the shell wall and located just above the fixed pin and pedestal 38. When assembled, the two housing shells with included pins 42 and 43 form a unitary cord lock housing 27 which is generally cylindrically shaped with two enlarged circular end plates 48 and 49 having flat outer surfaces. As will be shown, the cord lock housing can be snapped into and out of the molded cover 26 for replacement or repair as the case may be. Moreover, the housing readily pivots within the cover opening about the housing cylindrical axis for a purpose to be described.

Figure 8:
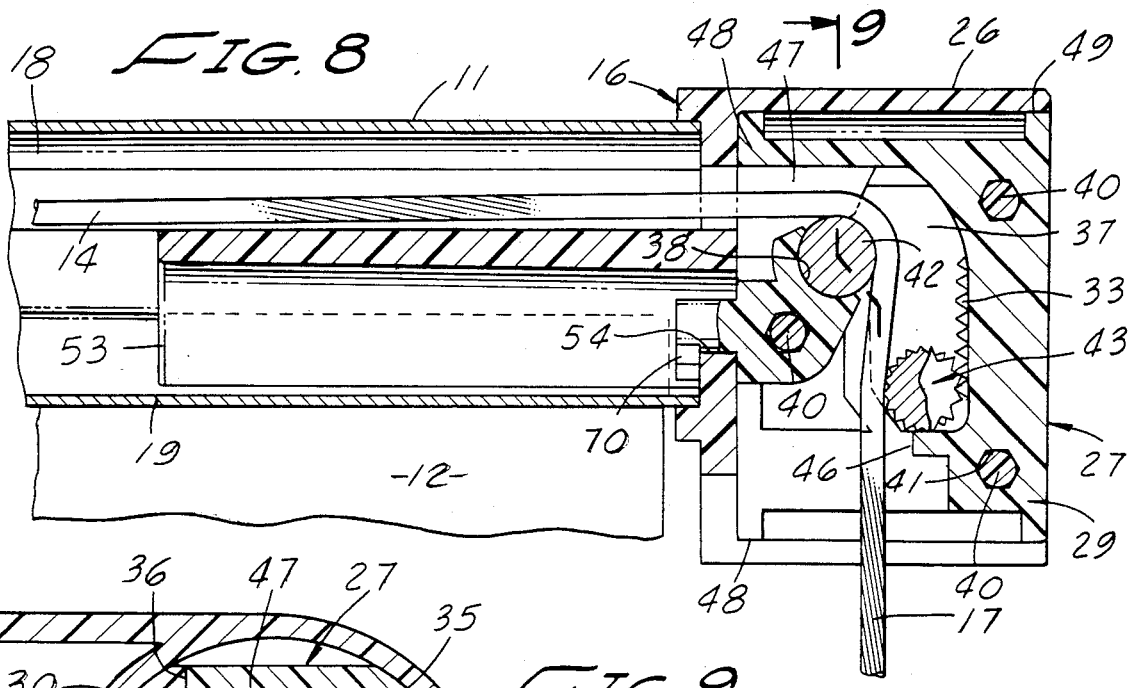
FIG. 8 is a front elevational, sectional view along the line 8—8 of FIG. 6.

As shown in FIG. 8, the internal spacing and relationship of the pins 42 and 43 are such that during a released or unlocked condition the cords received through slot 47 and passing over the top of the fixed pin 42 are contacted by the outer surface of the movable pin 43 when it rests at its lowermost position. That is, the cord in the totally released position between the two pins is held slightly out of vertical, thereby insuring that there will be a continuous contact with the splined surface of pine 43.

Returning to FIG. 13, cover 26 is an open shell affair including on one side an elongated platelike projection 50 of such dimensions as to permit a tight fitting and sliding receipt within the end opening of the headrail housing between the guide plate 23 and top panel of the housing 11 and firmly held by the upstanding guide plate members forming the channels 24 and 25. A beveled key 51 on the upper surface of 50 snaps through opening 52 in the headrail housing top wall when the cover 26 is assembled onto the headrail and in that way releasably locking the cover to the headrail.

A second projection 53 extends outwardly of the cover 26, spaced from and generally parallel to projection 50, and has a C-shaped cross-section enabling sliding fit within the open end of the headrail between the headrail front edge wall and the front edge of guide plate 23. On the outer side surface (the side opposite that from which projections 50 and 53 extend) there is a generally circular opening of such dimensions as to be able to receive the cord lock housing 27 therewithin to such an extent that the outermost housing disk 49 will be substantially coextensive with the outer surface of the cover. The inner face 48 has an axially located wedge-shaped key 70 for receipt through a similarly shaped keyway 54 when the lock housing is upside down, and which prevents removal of the lock housing when the housing is rightside up. In addition, the various part tolerances enable the housing 27 to pivot easily about its cylindrical axis for a purpose to be described.

Figure 3:
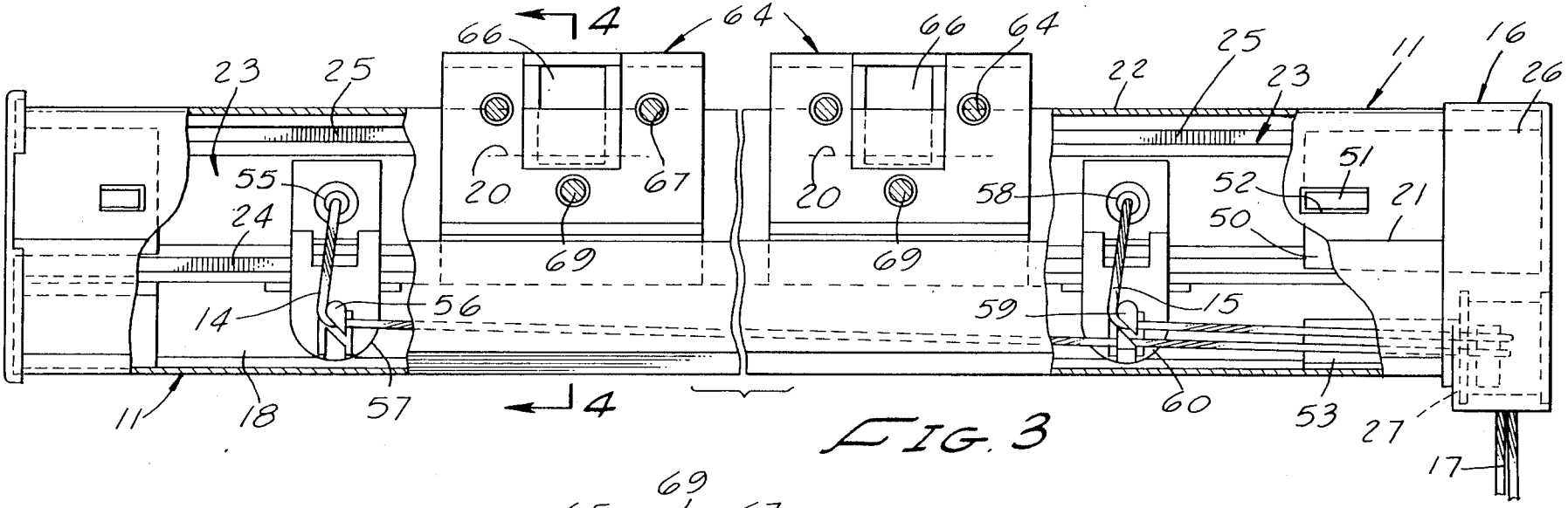
FIG. 3 is a top plan elevational, sectional, partially fragmentary view of an assembled cord lock mounted in place in a headrail.
Figure 12:
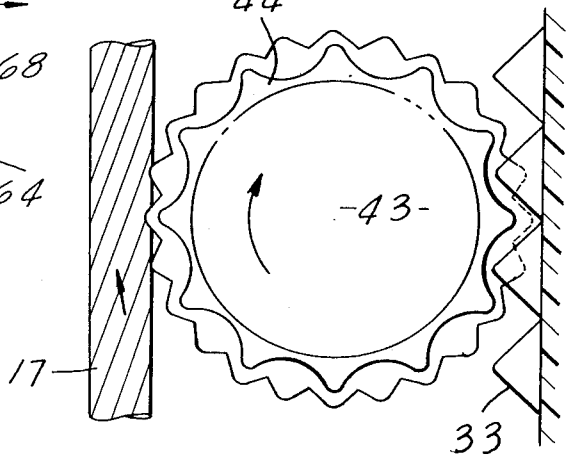
FIG. 12 is an enlarged end view of the locking pin, rack within which the pin travels and the cord.

In initial assembly, the cord 14 has a lower end affixed to lower rail 13, is threaded upwardly through openings in the pleated fabric 12 (FIG. 1), passes through a grommet 55 (FIG. 3), has its direction changed at an upstanding post 56 on guide 57 (FIG. 3) to extend along the headrail interior to the cord lock housing. The other cord 15 similarly has its lower end secured to the lower rail 13, passes through openings in the pleated fabric (FIG. 1) passes through a grommet 58 into the headrail interior, and has its direction changed by an upstanding post 59 on a further guide 60 shortly before entering the lock housing. The guide 60 has a second upstanding post 61 spaced from post 59 to engage cord 14 and hold it separate from cord 15 just before the cords enter the lock housing.

The guides 57 and 60 are each, in the form of a bracket having a first flat portion secured to the center of guide plate 23 and a second portion bent upwardly from and generally parallel to the first portion. The upstanding posts extend normally to the second flat portion. By the construction and relative location of the guide brackets, the cords are so arranged that pulling forces will be symmetrically induced in the headrail by the cords thereby preventing distortion, jamming or breakage of the various parts of the cords.

Figure 9:
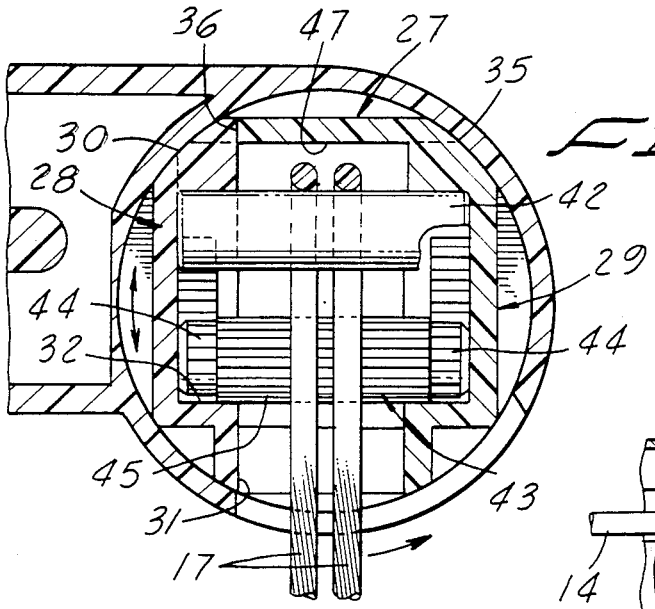
FIG. 9 is a side elevational, sectional view through the cord lock housing taken along line 9—9 of FIG. 8.

The cords 14 and 15 on leaving the guide bracket 60 pass over the outer surface of projection 53 and through a curved opening 63 and then through slotted opening 47 into the lock housing (FIGS. 5 and 6). The cords after entering the lock housing pass over fixed pin 42 and hang downwardly across and contacting the splined pin 43 (FIG. 9) with the lowermost end of the cords hanging downwardly through slot 46 collectively forming the hand-pull adjustment cord 17 shown in FIG. 1.

Figure 10:
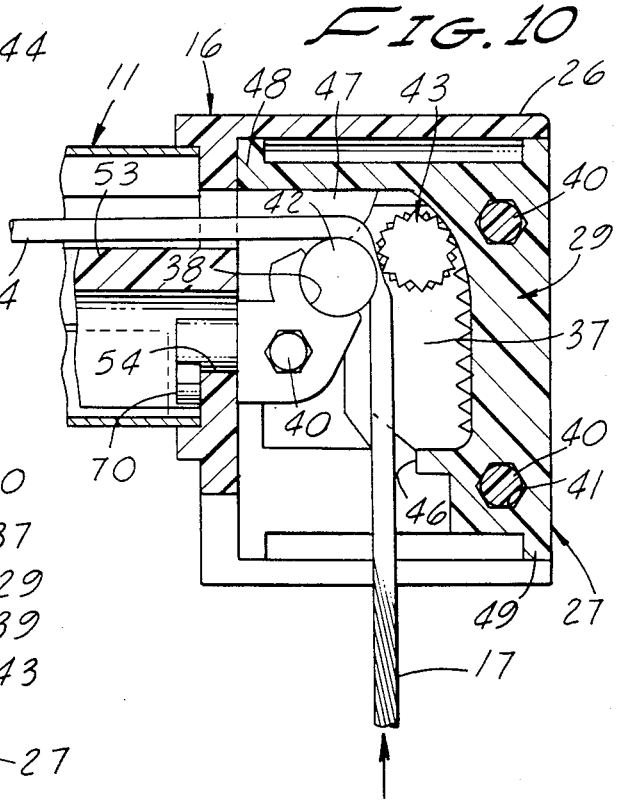
FIGS. 10 and 11 are side elevational, sectional views similar to FIG. 8 showing the cord fully locked and fully released, respectively.
Figure 11:
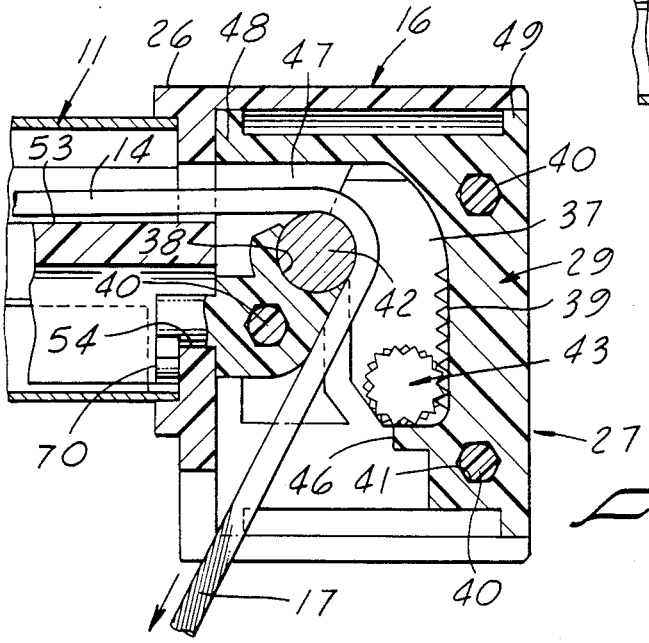

Downward pull on the hanging cord 17 raises the window fabric accordingly. When cord 17 is released the functional contact between the cords 14, 15 and the splines pulls the pin 43 upwardly causing it to roll along racks 33 and 39. This movement of pin 43 along the racks continues until a point is reached (FIG. 10) where the pin 43 locks the cords against fixed pin 42. The cords are now locked which simultaneously positions the window covering fabric at a particular vertical height. Unlocking or releasing the cords may be accomplished by either pulling down on the cords or the cord 17 may be held close to or even across the pleated fabric which will release the splined pin as shown in FIG. 11.

As can be seen in FIG. 8, the internal housing wall surface above the rack is smooth and curves toward the pin 42 as you move along the surface away from the rack. By the curvature of this smooth surface the splined pin 43 at its uppermost position is very close to pin 42, in effect, providing zero pinch. This feature is important in that as a result of use the cords become reduced in diameter and if the minimum distance between pins 42 and 43 were a fixed amount the cords would soon begin to slip. However, in the described lock the loss in diameter is accommodated by pin 43 moving upwardly sufficiently to be able to engage the cords.

In use of the described window covering, the cord 17 is sometimes pulled straight down, or, more often than not, angled forwardly. By the lock housing being pivotally mounted, variations in pull angle are accommodated for which reduces wear and tear, jamming and breakage that could otherwise result. See FIG. 9, for example, where the housing pivoting is indicated by the arrows.

Figure 4:
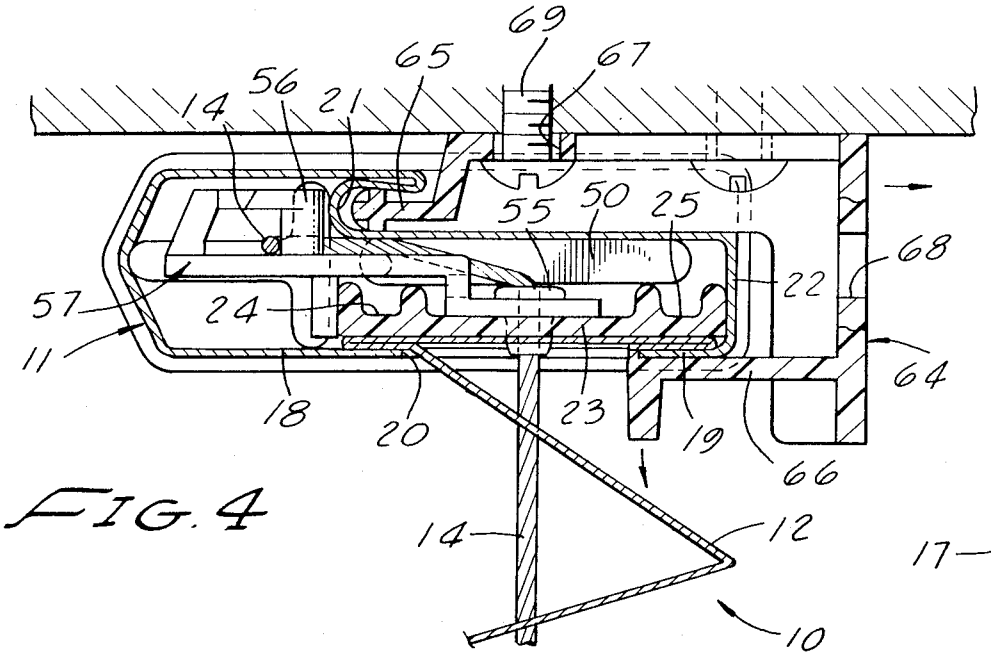
FIG. 4 is an elevational, sectional view taken along the line 4—4 of FIG. 3.

With particular reference to FIGS. 4 and 13, a mounting bracket 64 of a generally L-shaped cross-section can be releasably snapped onto the headrail 11 and serves as a means for hanging affixation to a ceiling or vertical wall surface. More particularly, a top plate of the bracket has an edge portion 65 with several longitudinal flutes or splines thereon, the edge portion being so dimensioned as to fit tightly within the headrail channel 21 on assembly of the bracket to the headrail. A centrally located retention arm 66 is integral with the bracket and extends in the same direction as the top plate in parallel and spaced apart relation. On assembly, the retention arm front edge snaps into the headrail bottom opening 20 securing the bracket to the headrail without the use of separate fastening means of any kind.

Openings 67 in the bracket top plate or 68 is bracket back plate enable securement to a ceiling or vertical wall surface, respectively, by threaded means 69. Typically, two such brackets will be used to mount a window covering unit.

Although materials may be found satisfactory, preferably the mounting bracket 64 is molded from a synthetic plastic exhibiting springlike characteristics permitting snapping of the bracket on and off the headrail as needed. Of course, a bracket may be mounted at any point along the headrail.

We claim:

1. In a cord lock for a window blind mounted onto a headrail and having a pair of cords threaded through openings in the blind for manipulative adjustment to raise or lower the window blind, the improvement comprising:

a guide plate within the headrail having a portion thereof adjacent an end opening of the headrail;

a cover releasably engaged with said guide plate portion to close off the headrail end opening, said cover having an opening in an outer surface; and a housing pivotally and releasably received within the cover outer surface opening, said housing including a cavity, a first pin fixedly mounted within the housing cavity, a second pin movably mounted within said housing cavity, and said cords located to pass between the first and second pins.

2. A cord lock as in claim 1, in which the housing wall defining the cavity includes two spaced apart toothed racks, two opposite end portions of the second pin being provided with teeth that mesh with the respective racks.

3. A cord lock as in claim 2, in which the housing wall defining the cavity at a point just beyond the end of the racks curves toward the fixed pin a sufficient amount to provide a minimum space between the pins which is substantially less than the thickness of one of the cords.

4. A cord lock as in claim 2, in which the central region of the second pin includes a plurality of longitudinal splines on an outer surface thereof.

5. A cord lock as in claim 1, in which the housing includes first and second shells interlocked together to form a generally cylindrical housing.

6. A cord lock as in claim 1, in which the cords pass through separate openings in the guide plate to the blind openings, and first and second upstanding posts on the guide plate adjacent the respective openings therein receive the cords and direct them along paths generally parallel to the headrail.

7. A cord lock as in claim 1, in which the housing is generally cylindrical and is received in a generally circular opening in the cover, an end surface of said housing having a keyway for receipt in a similarly shaped keyway in the cover wall defining the opening therein.

8. A cord lock as in claim 1, in which there are further provided at least one mounting bracket including a top plate, a back plate and a retention arm, said retention arm being spaced from and extending in the same direction as said top plate, the headrail including a channel and a bottom opening for receiving respectively the top plate and retention arm releasably clamping the headrail therebetween.

* * * * *